US008228152B2

(12) United States Patent
Lu et al.

(10) Patent No.: US 8,228,152 B2
(45) Date of Patent: Jul. 24, 2012

(54) TRANSFORMING DEVICE OF POWER SOURCE AND TRANSFORMER THEREOF

(75) Inventors: Zeng-Yi Lu, Taoyuan Hsien (TW); Wei Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 222 days.

(21) Appl. No.: 11/812,647

(22) Filed: Jun. 20, 2007

(65) Prior Publication Data

US 2008/0018425 A1 Jan. 24, 2008

(30) Foreign Application Priority Data

Jul. 21, 2006 (TW) ..... 95126652 A

(51) Int. Cl.

| | |
|---|---|
| ***H01F 27/32*** | (2006.01) |
| ***H01F 27/36*** | (2006.01) |
| ***H01F 38/12*** | (2006.01) |
| ***H01F 38/30*** | (2006.01) |

(52) U.S. Cl. ..... 336/84 R; 336/84 C; 336/84 M

(58) Field of Classification Search ..... 336/84 C, 336/84 R, 84 M

See application file for complete search history.

(56) References Cited

U.S. PATENT DOCUMENTS

| | | | | |
|---|---|---|---|---|
| 4,089,049 | A * | 5/1978 | Suzuki et al. | 363/17 |
| 4,507,721 | A * | 3/1985 | Yamano et al. | 363/20 |
| 5,107,411 | A * | 4/1992 | Misdom | 363/20 |
| 5,724,236 | A * | 3/1998 | Oglesbee | 363/40 |
| 6,005,355 | A * | 12/1999 | Siao | 315/277 |
| 6,211,767 | B1 * | 4/2001 | Jitaru | 336/200 |
| 6,704,211 | B1 * | 3/2004 | Vogman | 363/20 |
| 6,813,168 | B2 * | 11/2004 | Balakrishnan | 363/44 |
| 6,950,291 | B1 * | 9/2005 | Andres et al. | 361/38 |

FOREIGN PATENT DOCUMENTS

JP 58077212 A * 5/1983

* cited by examiner

*Primary Examiner* — Mohamad Musleh
*Assistant Examiner* — Tsz Chan
(74) *Attorney, Agent, or Firm* — Birch, Stewart, Kolasch & Birch, LLP

(57) ABSTRACT

A transformer includes a magnetic element, a first winding, a second winding and a shield. The first winding is wound outside the magnetic element, the second winding is wound outside the first winding, and the shield is disposed between the first winding and the second winding.

7 Claims, 9 Drawing Sheets

1

1

2

2

TRANSFORMING DEVICE OF POWER SOURCE AND TRANSFORMER THEREOF

CROSS REFERENCE TO RELATED APPLICATIONS

This Non-provisional application claims priority under 35 U.S.C. §119(a) on Patent Application No(s). 095126652 filed in Taiwan, Republic of China on Jul. 21, 2006, the entire contents of which are hereby incorporated by reference.

BACKGROUND OF THE INVENTION

1. Field of Invention

The invention relates to a transforming device of a power source and a transformer thereof.

2. Related Art

Currently, electronic circuits are widely applied in electronic devices including transforming devices of power sources, such as power supplies and electric energy converters. However, this kind of circuit often operates via high-frequency switching so that electromagnetic interference (EMI) tends to occur and thus influences the operation of the electronic device. EMI may be divided into radiated EMI and conducted EMI according to the mode of interference transfer. Radiated EMI is transferred directly in an open space, and the conducted EMI is transferred through wires.

Conducted EMI may further be divided into common-mode noise EMI occurring when all wires have the same current flow direction, and differential-mode noise EMI occurred when two wires have opposite current flow directions according to the noise current conducting path.

In order to effectively eliminate the EMI, an inductor for eliminating the noises is usually disposed in the electronic device according to the kinds of the noise. For example, if the common-mode noise has to be eliminated, a common mode inductor and a capacitor are disposed in the electronic device so that the common-mode noise may be eliminated. If a differential-mode noise has to be eliminated simultaneously, a differential-mode inductor and another capacitor are needed into the electronic device so that the differential-mode noise may be eliminated. However, with the development of the electronic technology, the multi-functionality and required power density requirements placed on electronic devices are steadily increased. Correspondingly, the size of the inductor needs to be minimized. The most effective method for reducing the size and the cost of the inductor is to reduce the original noise of the electronic device. Because the common mode inductor available on the market is large and complicated to manufacture, decreasing the common-mode noise has become an important subject of enhancing the transforming device.

FIG. 1 shows an equivalent circuit of a conventional transforming device 1. Referring to FIG. 1, the transforming device 1 includes a transformer 11, a bridge rectifier 12, a capacitor 13 and a transistor 14, which are electrically connected to one another. The transformer 11 has a primary winding 111 wound outside a magnetic element (not shown), and a secondary winding 112 wound outside the primary winding 111. The transforming device 1 receives an AC voltage V1, which is externally inputted to the bridge rectifier 12 and inputted to the transistor 14 through a rectified voltage. The transistor 14 performs switching operations according to an externally inputted pulse width modulation (PWM) signal P1. The rectified voltage is subsequently transferred to the transformer 11 to generate a DC voltage V2. The common-mode noise is usually caused by the voltage trip of the secondary winding 112 or the primary winding 111 of the transformer 11, or caused by the coupling of the parasitic parameters.

FIG. 2 shows the measured results of the common-mode noise obtained from the transforming device 1. At present, the frequency range of the standard EMI is between 0.15 MHz and 30 MHz. As shown in the drawing, it is obtained that the common-mode noise value of the transforming device 1 is about 76 dB.

The prior arts mainly use the following two methods to eliminate the common-mode noise. As shown in FIG. 3, the first method for eliminating the common-mode noise is to add a winding 113 between the primary winding 111 and the secondary winding 112 in the transformer 11, and the winding 113 is electrically connected to a capacitor 15. Consequently, a phase complementary voltage is generated between the primary winding 111 and the secondary winding 112 and a common mode current for offsetting the common mode current of the transformer 11 is generated according to the phase complementary voltage. However, this method complicates the design of the transformer 11 due to the added winding 113, and also increases the manufacturing cost.

As shown in FIG. 4, the second method for eliminating the common-mode noise is to add a Faraday mask layer M to the transformer 11 of the transforming device 1. The Faraday mask layer M covers the secondary winding 112 and is electrically connected to the primary winding 111 so that the common mode current flowing from the primary winding 111 to the secondary winding 112 may be reduced. However, this method increases the capacitance of the secondary winding 112 with respect to the primary winding 111. Hence, it is quite difficult to suppress the common-mode noise.

Thus, it is an important subject of the invention to provide a transforming device of a power source and a transformer thereof capable of eliminating the common-mode noise so that the size and the manufacturing cost of the transforming device of a power source or the transformer may be reduced and the power density can be enhanced.

SUMMARY OF THE INVENTION

In view of the foregoing, the invention is to provide a transforming device of a power source and a transformer thereof capable of eliminating the common-mode noise to reduce the size and the manufacturing cost and to increase the power density.

To achieve the above, the invention discloses a transformer including a magnetic element, a first winding, a second winding and a shield. The first winding and the second winding disposed around the magnetic element. The shield is disposed between the first winding and the second winding.

To achieve the above, the invention also discloses a transforming device of a power source including a transformer and a first capacitor. The transformer includes a magnetic element, a first winding, a second winding and a shield. The first winding and the second winding disposed around the magnetic element. The shield is disposed between the first winding and the second winding. The first capacitor is electrically connected to the shield.

As mentioned above, the transformer according to the invention has the shield disposed between the first winding and the second winding, and the transforming device according to the invention has the first capacitor, which is serially connected to and between the shield and the first winding and electrically connected to the first capacitor. Compared to the prior art, the invention can balance the common mode current between the first winding and the second winding through the cooperation of the shield and the first capacitor so that the common-mode noise can be reduced. In addition, the size and the cost of the common mode filter to be added to the transforming device can be reduced, the loss can be improved and the power density can be enhanced so that the efficiency in use may be enhanced.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 5:
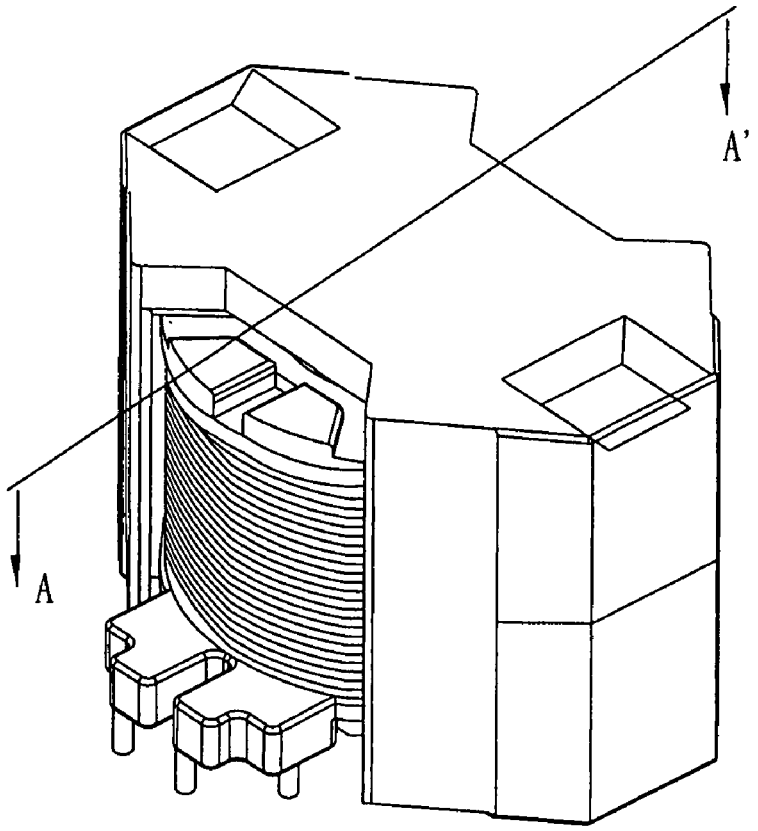
FIG. 5 is a schematic illustration showing a transformer according to a preferred embodiment of the invention.
Figure 6:
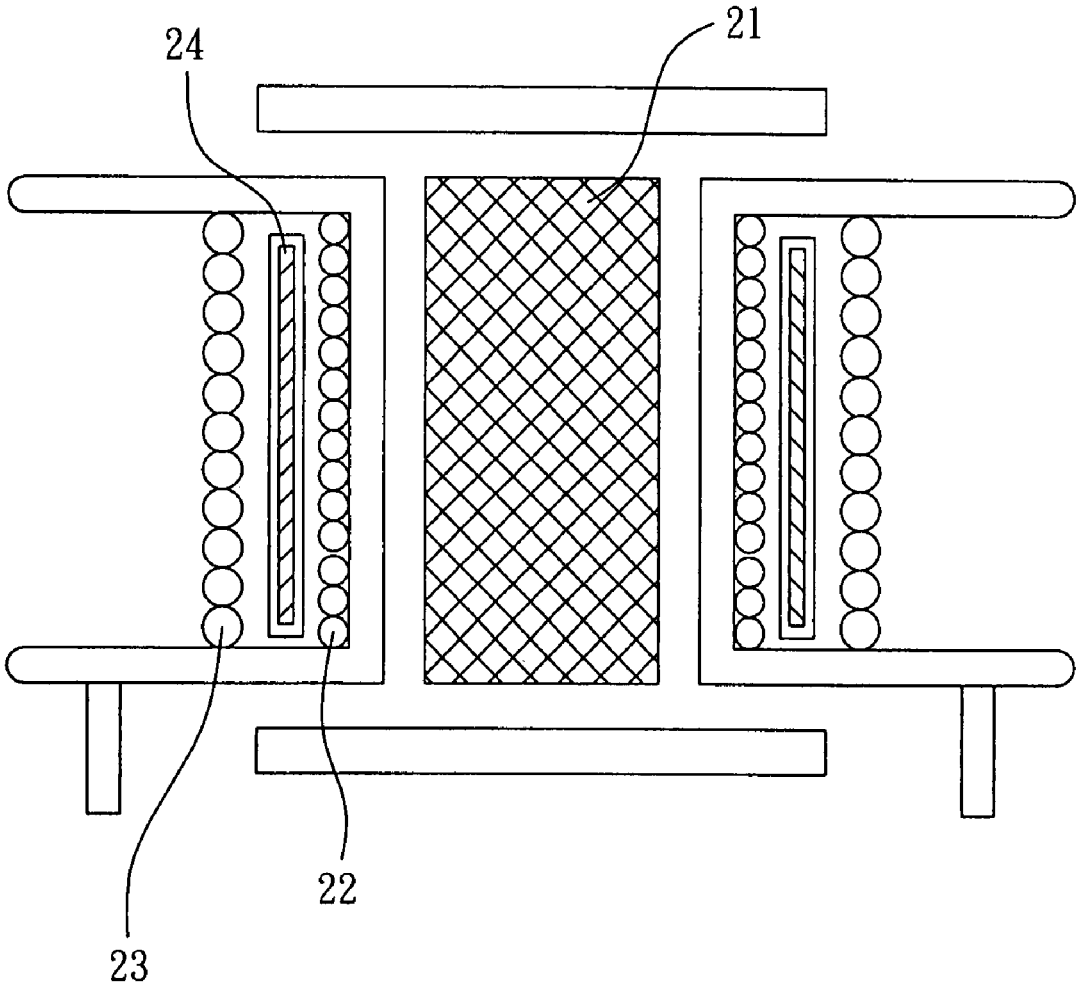
FIG. 6 is a schematic cross-sectional view of the transformer along line A-A' of FIG. 5.

Referring to FIGS. 5 and 6, a transformer 2 according to a preferred embodiment of the invention includes a magnetic element 21, a first winding 22, a second winding 23 and a shield 24. The transformer 2 may be applied to a power switching device or an inverter. In this embodiment, the magnetic element 21 is made of, without limitation to, a magnet or a magnetic bolt, and the magnetic element 21 has, without limitation to, a cylindrical shape.

The first winding 22 is wound outside the magnetic element 21, and the second winding 23 is wound outside the first winding 22. The first winding 22 and the second winding 23 may be made by winding a single conductive wire, or separate conductive wires. Herein, the first winding 22 is the primary winding, and the second winding 23 is the secondary winding. The second winding 23 may also be the primary winding, and the first winding 22 may be the secondary winding.

The shield 24 is disposed between the first winding 22 and the second winding 23 to prevent the first winding 22 from contacting the second winding 23. The shield 24 must be made of a conductive material, such as copper.

Figure 7:
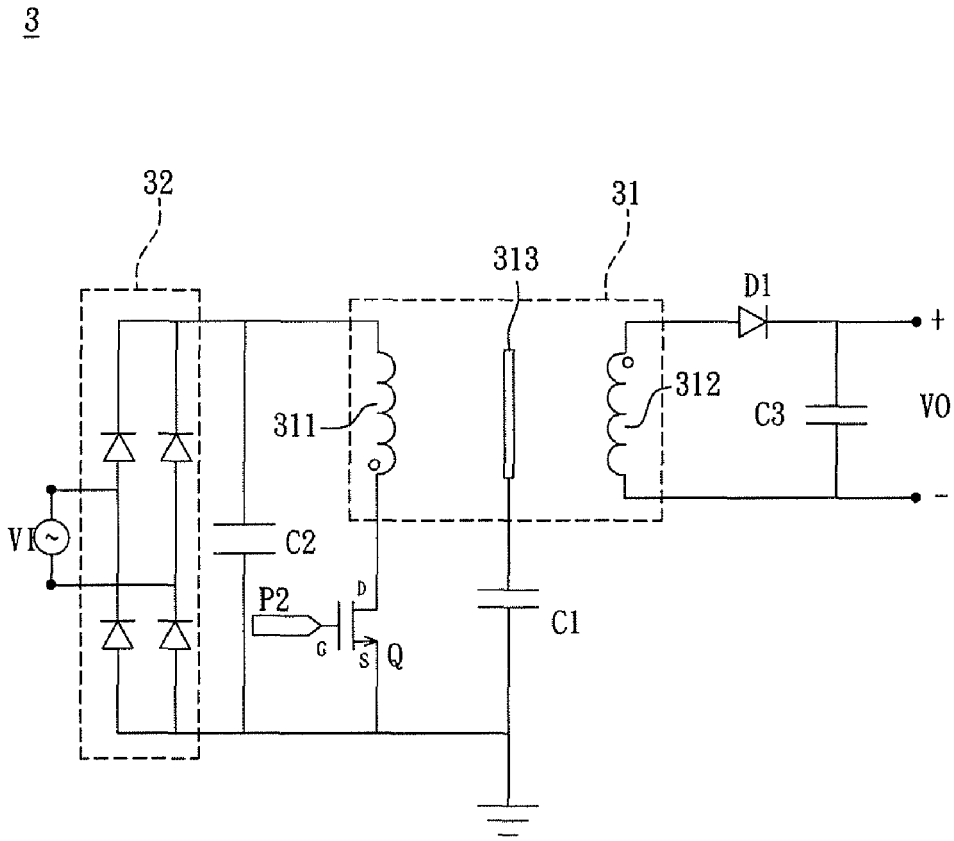
FIG. 7 shows an equivalent circuit showing a transforming device of a power source according to a preferred embodiment of the invention.

In the following example to be described, the transformer 2 is applied to the transforming device of a power source. FIG. 7 shows an equivalent circuit showing a transforming device 3 according to a preferred embodiment of the invention. Referring to FIG. 7, the transforming device 3 includes a transformer 31 and a first capacitor C1. The application of the transforming device 3 of this embodiment is a flyback converter, but not particularly limited, and may be applied to circuit topology, as, for example, a forward converter, a half-bridge converter or a full-bridge converter.

In this embodiment, the transformer 31 includes a magnetic element (not shown), a first winding 311, a second winding 312 and a shield 313. A terminal of the first winding and a terminal of the second winding have the same polarity. The transformer 31 of this embodiment and the transformer 2 in the above-mentioned embodiment (see FIGS. 5 and 6) have the same structure, features, function and aspects so that detailed descriptions thereof will be omitted.

The first capacitor C1 has a first terminal electrically connected to the shield 313, and a second terminal electrically connected to the first winding 311. In addition, the first capacitor C1 may also be electrically connected to the second winding 312 (not shown).

The transforming device 3 further includes a rectifier 32, a second capacitor C2 and a transistor Q. Two terminals of the rectifier 32 are respectively electrically connected to a first terminal of the first winding 22 and the second terminal of the first capacitor C1, and the rectifier 32 receives an external input voltage V1, which is an AC voltage, for example. The rectifier 32 of this embodiment is a bridge rectifier, which may be a full-bridge circuit or a half-bridge circuit, and is a full-bridge circuit in this example.

The second capacitor C2 has a first terminal electrically connected to a first terminal of the first winding 311, and a second terminal electrically connected to the second terminal of the first capacitor C1. The second capacitor C2 of this embodiment has the functions of filtering and stabilizing the DC voltage.

In addition, the transistor Q is disposed between the first winding 311 and the first capacitor C1. That is, the transistor Q has a drain D electrically connected to a second terminal of the first winding 311, a source S electrically connected to the second terminal of the first capacitor C1, and a gate G for receiving an external pulse width modulation signal P2. The transistor Q of this embodiment is not particularly limited and may be implemented as a metal oxide semiconductor field effect transistor (MOSFET).

When the pulse width modulation signal P2 controls the transistor Q to perform the switching operation, the DC voltage is transformed into a series of voltage pulses outputted to the first winding 311 according to on and off operations of the transistor Q. At this time, the first winding 311 receives the voltage pulses and utilizes the magnetic element to generate the magnetic effect of electric current so that the second winding 312 is induced and then outputs an induced voltage according to the principle of electromagnetic induction and the magnetic effect on electric current. Thus, in implementation, the transformer 31 of this embodiment has the pulse width modulation signal P2 so that the input power may be modulated and the proper load may be supplied.

The transforming device 3 further includes a diode D1 and a third capacitor C3. The diode D1 is disposed between the second winding 312 and the third capacitor C3. That is, the diode D1 has a first terminal electrically connected to a first terminal of the third capacitor C3, and a second terminal electrically connected to a first terminal of the second winding 312. In this embodiment, the diode D1 is not particularly limited and may be implemented as a rectifying diode or a fast diode. A second terminal of the third capacitor C3 is electrically connected to a second terminal of the second winding 312. The third capacitor C3 of this embodiment filters out ripple components of the converted DC voltage and then outputs a DC output voltage VO.

Figure 8:
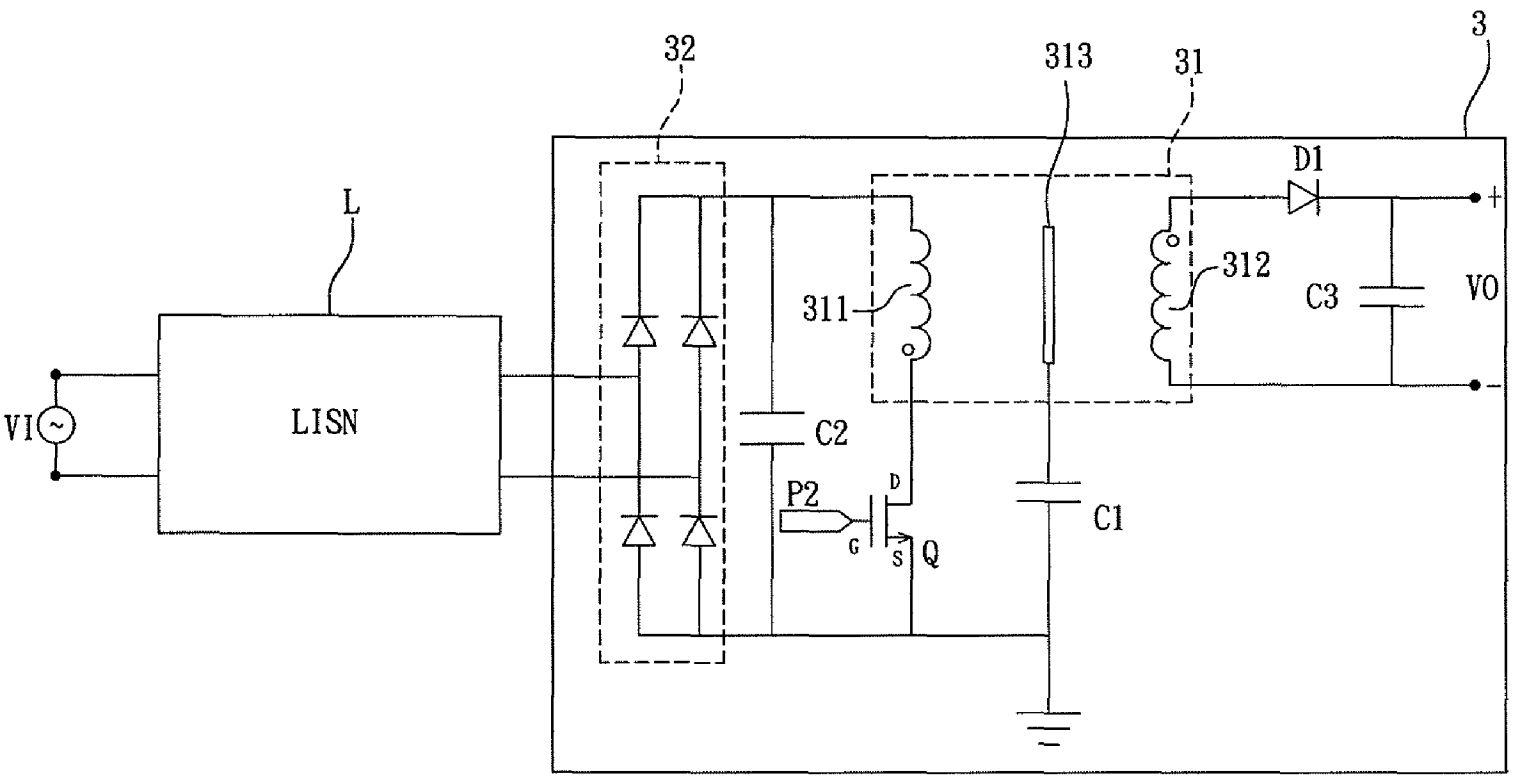
FIG. 8 is a schematic illustration showing the transforming device of FIG. 7, which is connected to a line impedance stabilization network (LISN)

In addition, the common-mode noise in the transforming device 3 is caused by the parasitic capacitance and stray capacitance effects on the transistor Q, the diode D1 and the transformer 31. Therefore, a line impedance stabilization network (LISN) L serving as a measurement tool for the conducted EMI is electrically connected to and between the input voltage V1 and the rectifier 32 of the transforming device 3, as shown in FIG. 8. In addition, the relationship between the common-mode noise value and the frequency in the transforming device 3 may be obtained through the LISN L.

Figure 1:
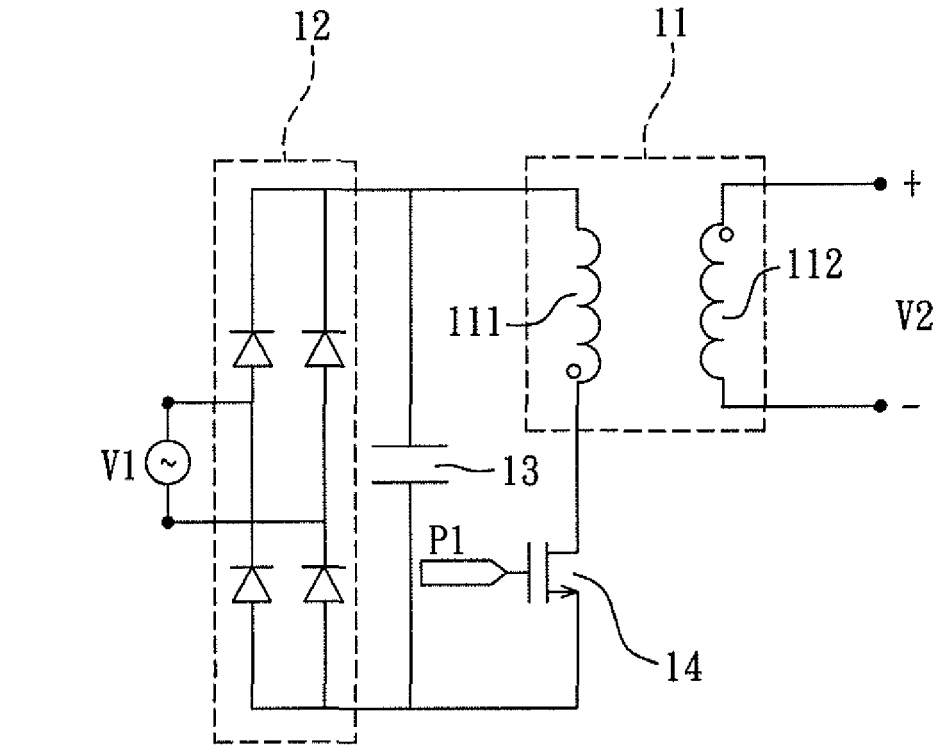
FIG. 1(PRIOR ART)
FIG. 1 shows an equivalent circuit of a conventional transforming device of a power source.
Figure 2:
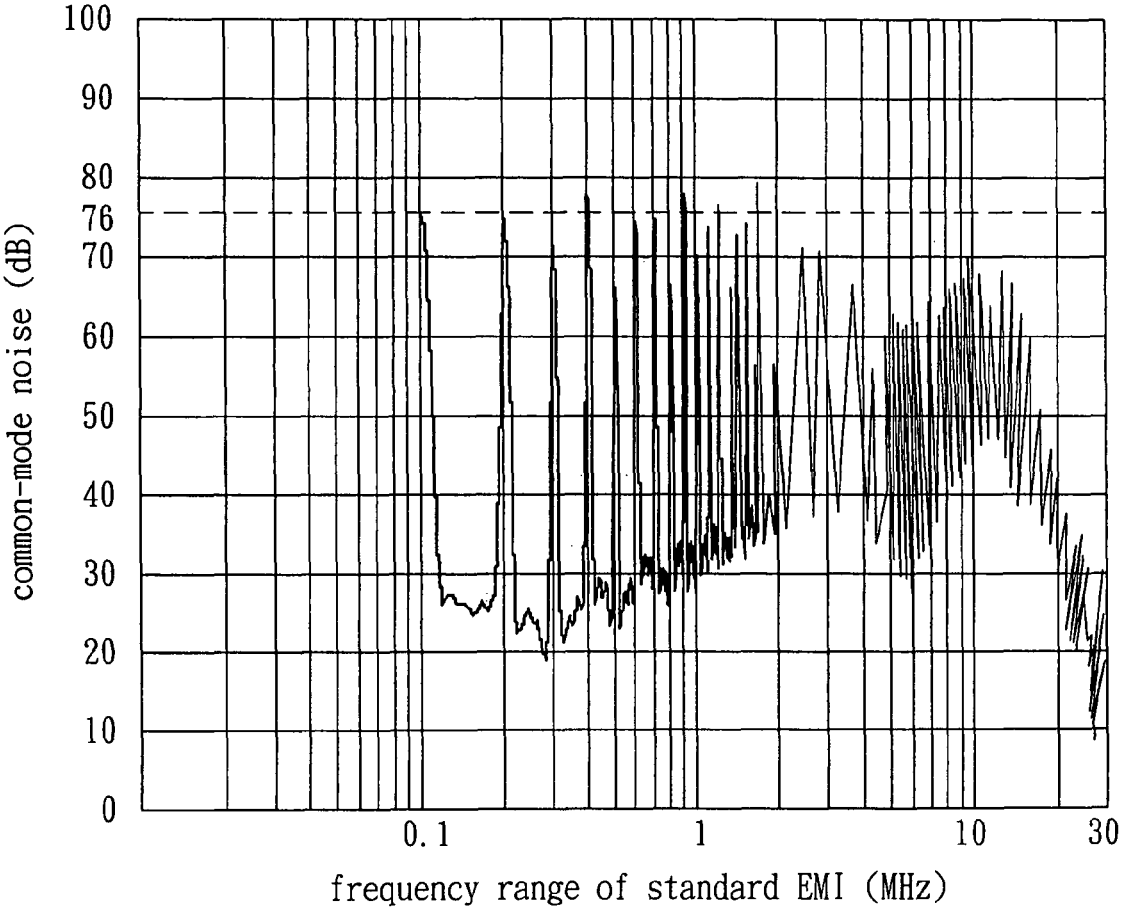
FIG. 2(PRIOR ART)
FIG. 2 is a schematic illustration showing the relationship between common-mode noise and a frequency range of standard EMI in the transforming device of FIG. 1.
Figure 3:
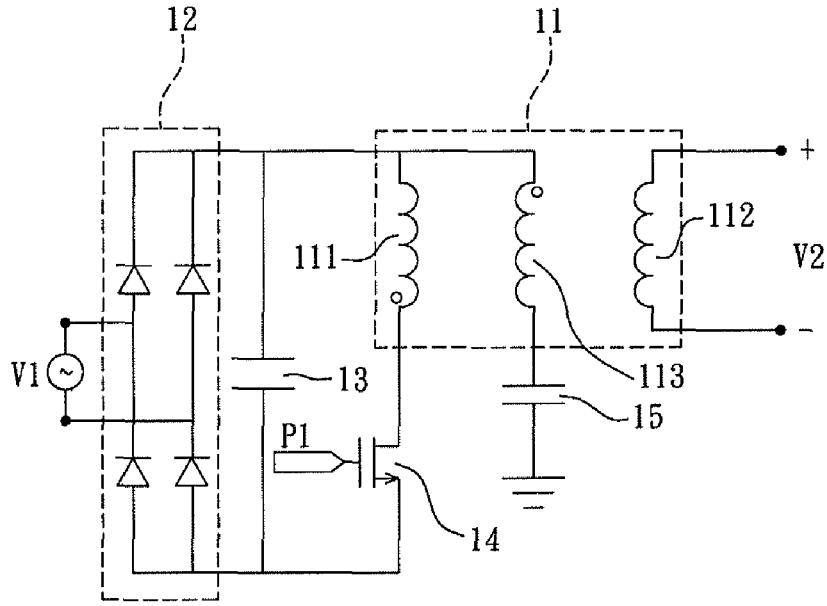
FIG. 3(PRIOR ART)
FIG. 3 is a schematic illustration showing a conventional transforming device of a power source capable of eliminating common-mode noise.
Figure 4:
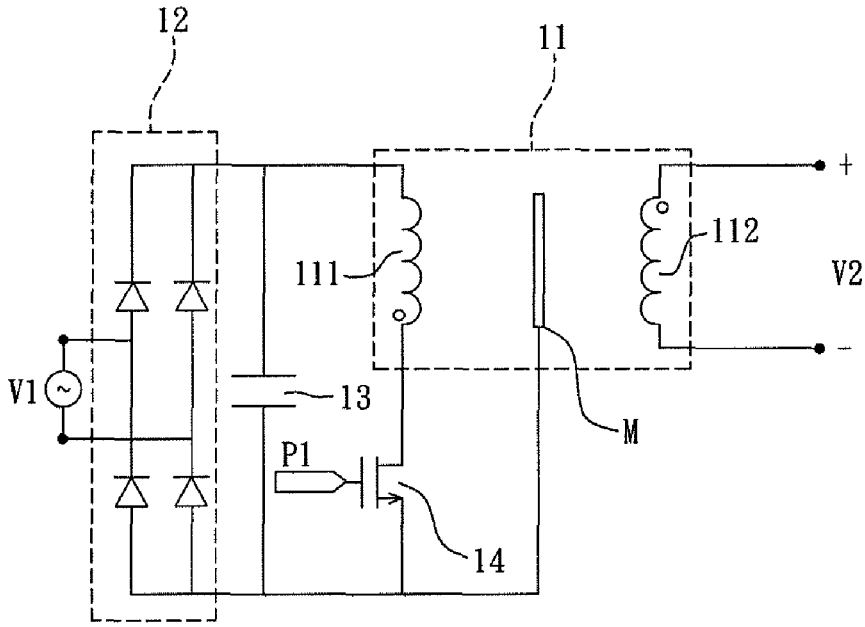
FIG. 4(PRIOR ART)
FIG. 4 is a schematic illustration showing another conventional transforming device of a power source capable of eliminating common-mode noise.
Figure 9:
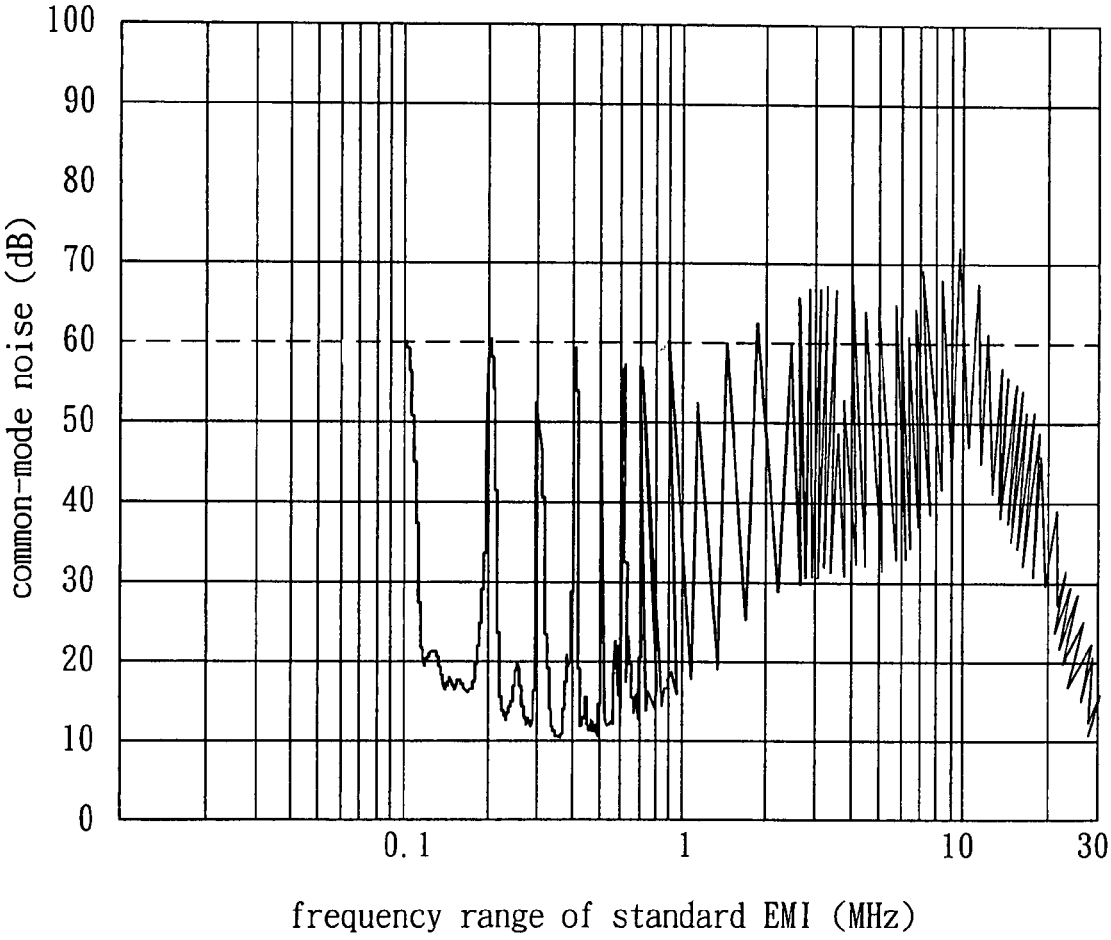
FIG. 9 is a schematic illustration showing a relationship between common-mode noise and a frequency range of the standard EMI in the transforming device of FIG. 7.

As shown in FIG. 9, when the LISN L is adopted to measure the transforming device 3, the measured result of the common-mode noise of the transforming device 3 may be measured and obtained, and the common-mode noise value of the transforming device 3 is obtained as about 60 dB. Compared to the measured result (see FIG. 2) of the common-mode noise in the conventional transforming device 1 (see FIG. 1), the transforming device 3 of this embodiment can effectively reduce the common-mode noise value by about 16 dB.

In summary, the transformer according to the invention has the shield disposed between the first winding and the second winding, and the transforming device of a power source according to the invention has the first capacitor, which is serially connected to and between the shield and the first winding and electrically connected to the first capacitor. Compared with the prior art, the invention can balance the common mode current between the first winding and the second winding through the cooperation of the shield and the first capacitor so that the common-mode noise can be reduced. In addition, the size and the cost of the common mode filter to be added to the transforming device can be reduced, the loss can be improved and the power density can be enhanced so that the efficiency in use may be enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A transformer, applied in a flyback transformer device which comprises a transistor for performing switch operation and used with a single first capacitor, comprising:

a magnetic element;

a first winding and a second winding, both of which are disposed around the magnetic element, wherein a terminal of the first winding and a terminal of the second winding have the same polarity; and a shield disposed between the first winding and the second winding, wherein a terminal of the shield is directly electrically connected to a first terminal of the first capacitor, and a second terminal of the first capacitor is electrically connected to an electrical potential point with an invariable voltage level and the transistor;

wherein the first terminal of the first capacitor is a floating point and the second terminal of the first capacitor is electrically connected to a fixed point of the first winding, and wherein the shield cooperates with the first capacitor to balance the common mode current between the first winding and the second winding so as to reduce a common-mode noise.

2. The transformer according to claim 1, wherein the magnetic element is made of a magnet or a magnetic bolt.

3. The transformer according to claim 1, wherein the magnetic element has a cylindrical shape.

4. The transformer according to claim 1, wherein the shield comprises a conductive material or copper.

5. The transformer according to claim 1, wherein the first winding is a primary winding and the second winding is a secondary winding, or the first winding is the secondary winding and the second winding is the primary winding.

6. The transformer according to claim 1, being applied to a power switching device or an inverter.

7. A flyback transforming device of an isolated power source comprising:

a transistor performing switching operation;

a transformer comprising a magnetic element, a first winding, a second winding and a shield, wherein the first winding and the second winding are disposed around the magnetic element, and the shield is disposed between the first winding and the second winding, and a terminal of the first winding and a terminal of the second winding have the same polarity; and a single first capacitor electrically connected to the shield, wherein a first terminal of the first capacitor is connected to a terminal of the shield, and a second terminal of the first capacitor is connected to an electrical potential point with an invariable voltage level and the transistor;

wherein the first terminal of the first capacitor is a floating point and the second terminal of the first capacitor is electrically connected to a fixed point of the first winding, and wherein the shield cooperates with the first capacitor to balance the common mode current between the first winding and the second winding so as to reduce a common-mode noise.

* * * * *